US011154178B2

(12) United States Patent
Zhu et al.

(10) Patent No.: US 11,154,178 B2
(45) Date of Patent: Oct. 26, 2021

(54) MOP CLEANING SYSTEM

(71) Applicant: JIAXING JACKSON TRAVEL PRODUCTS CO., LTD, Jiaxing (CN)

(72) Inventors: Chenhui Zhu, Jiaxing (CN); Juhong Zhang, Jiaxing (CN); Kaifeng Lu, Jiaxing (CN)

(73) Assignee: JIAXING JACKSON TRAVEL PRODUCTS CO., LTD.

( * ) Notice: Subject to any disclaimer, the term of this patent is extended or adjusted under 35 U.S.C. 154(b) by 314 days.

(21) Appl. No.: 16/017,163

(22) Filed: Jun. 25, 2018

(65) Prior Publication Data

US 2019/0216287 A1 Jul. 18, 2019

(30) Foreign Application Priority Data

| | | |
|---|---|---|
| Jan. 16, 2018 | (CN) | 201820063572.8 |
| Feb. 2, 2018 | (CN) | 201810106882.8 |
| Feb. 2, 2018 | (CN) | 201810107978.6 |
| Apr. 28, 2018 | (CN) | 201820631096.5 |
| Apr. 28, 2018 | (CN) | 201820640766.X |

(51) Int. Cl.

| | |
|---|---|
| ***A47L 13/58*** | (2006.01) |
| ***A47L 13/256*** | (2006.01) |
| ***A47L 13/60*** | (2006.01) |

(52) U.S. Cl.

CPC ..... *A47L 13/58* (2013.01); *A47L 13/256* (2013.01); *A47L 13/60* (2013.01)

(58) Field of Classification Search

CPC ..... A47L 13/58; A47L 13/256; A47L 13/60

See application file for complete search history.

(56) References Cited

U.S. PATENT DOCUMENTS

| | | | | |
|---|---|---|---|---|
| 8,365,341 | B2 * | 2/2013 | Lin | A47L 13/58 15/229.6 |
| 8,978,194 | B1 * | 3/2015 | Lentine | A47L 13/58 15/260 |
| 2011/0049046 | A1 * | 3/2011 | Yu | A47L 13/58 210/512.3 |
| 2011/0113585 | A1 * | 5/2011 | Chu | A47L 13/58 15/261 |
| 2011/0197463 | A1 * | 8/2011 | Shih | A47L 13/58 34/108 |
| 2011/0225762 | A1 * | 9/2011 | Tsai | A47L 13/58 15/260 |
| 2011/0239389 | A1 * | 10/2011 | Ting | A47L 13/58 15/120.2 |
| 2012/0192373 | A1 * | 8/2012 | Chen | A47L 13/58 15/228 |
| 2017/0231457 | A1 * | 8/2017 | Cloud | B01D 21/2488 210/195.1 |
| 2018/0028040 | A1 * | 2/2018 | Delangue | A47L 13/60 |

FOREIGN PATENT DOCUMENTS

| | | |
|---|---|---|
| CN | 203576444 U | 5/2014 |

* cited by examiner

*Primary Examiner* — Weilun Lo

(57) ABSTRACT

A mop cleaning system, comprising a cleaning bucket and a mop. The mop comprises a mop stick and a mop head. The mop stick is connected to the mop head. A support body supporting the mop is disposed in the cleaning bucket. A roller is disposed in the cleaning bucket. The roller is rotatably disposed with the axis thereof as a rotation axis. During cleaning, the mop head rotates to drive the roller to rotate.

4 Claims, 11 Drawing Sheets

MOP CLEANING SYSTEM

TECHNICAL FIELD OF THE INVENTION

The present invention relates to a mop cleaning system, belonging to the technical field of cleaning products.

BACKGROUND OF THE INVENTION

In CN203576444U, a mop bucket using central-shaft elevation comprises a bucket body and further comprises a central shaft and a shaft sleeve. The central shaft is disposed at the bottom of the bucket. A combined slide groove for the shaft sleeve to slide up and down is disposed in the central shaft. A bearing is sleeved over the shaft sleeve. A dewatering basket is sleeved over the bearing. A prismatic column for clamping a mop is disposed at the dewatering basket. In the foregoing technical solution, when the mop is cleaned, a mop head rotates to drive water to rotate. However, this arrangement causes water to splash in the bucket. The self-cleaning of the mop head completely depends on waves in the water, and a self-cleaning effect is poor. Therefore, a cleaning effect is undesirable.

SUMMARY OF THE INVENTION

The objective of the present invention is to provide a mop cleaning system having an improved cleaning effect to overcome the foregoing deficiencies that exist in the prior art.

The technical solution used in the present invention to resolve the foregoing problem is a mop cleaning system, comprising a cleaning bucket and a mop. The mop comprises a mop stick and a mop head. The mop stick is connected to the mop head. A support body supporting the mop is disposed in the cleaning bucket. A roller is disposed in the cleaning bucket. The roller is rotatably disposed with the axis thereof as a rotation axis. During cleaning, the mop head rotates to drive the roller to rotate.

Furthermore, the mop cleaning system further comprises a roller mounting frame. The roller mounting frame is disposed at the support body and/or the cleaning bucket. The roller is rotatably connected to the roller mounting frame.

Furthermore, one end of the roller is rotatably connected to the support body. The other end of the roller is rotatably connected to the cleaning bucket.

Furthermore, a structure by which the mop rotates to drive the roller to rotate is that when the mop head is placed in the support body for cleaning, the mop head is in contact with the roller.

Furthermore, a structure by which the mop rotates to drive the roller to rotate comprises a transmission mechanism. The transmission mechanism comprises a rotating member and a driven gear fixedly disposed at the roller, with one end of the rotating member being provided with a driving gear engaged with the driven gear, and the other end of the rotating member being provided with a connecting portion for circumferentially limiting after being connected to the mop head. The rotating member is rotatably connected to the support body.

Furthermore, the support body is disposed perpendicular to a bucket bottom of the cleaning bucket. The axial direction of the roller and an axial direction of the support body are disposed perpendicular to each other.

Furthermore, the support body is disposed perpendicular to a bucket bottom of the cleaning bucket. The axial direction of the roller and an axial direction of the support body are disposed perpendicular to each other.

Furthermore, a water feeding groove is disposed at the roller. An included angle formed between a connecting line from a middle point of an opening of the water feeding groove to the bottom of the water feeding groove and a tangent line extending from the middle point in a rotation direction is an acute angle.

Furthermore, the support body comprises a fixed shaft and a lift shaft sleeved over each other and capable of axially moving relative to each other. The support body further comprises a track used to connect the fixed shaft and the lift shaft and a limiting boss fitting the track. The track comprises a bottom slot hole and a middle upper slot hole connected through a connecting slot; and a rotating shaft is mounted at a top end of the lift shaft, the rotating shaft is rotatably connected to a rotating member, and the fixed shaft is fixedly connected to the cleaning bucket.

Furthermore, the mop head comprises a base, a housing, and a swing member. The swing member is rotatably connected to the base. The swing member extends to drive the housing. The housing is movably mounted relative to the base. The mop stick is movably connected to the base.

Furthermore, the housing comprises an upper cover and a bottom plate. The upper cover and the bottom plate have, after being joined, a spare space for accommodating the swing member. The swing member is disposed in the spare space.

Furthermore, the upper cover is provided with an open hole. The base is disposed at the open hole. The base comprises an upper base and a lower base. The upper base is provided with a notch. The swing member moves in the notch and is rotatably connected to the upper base. The upper base is threadedly connected to the lower base.

Furthermore, the mop cleaning system further comprises a locking mechanism for locking the housing and the base. The locking mechanism comprises a hook, a hanged portion, a control member, and a recess provided on the support body of the cleaning bucket. The recess corresponds to the control member. The control member can be seated into the recess. The hook and the hanged portion can be securely hooked. A force is applied to the control member to push the hanged portion to be unhooked from the hook; and the hook is disposed at the housing, and the hanged portion is disposed at the base, or alternatively, the hook is disposed at the base, and the hanged portion is disposed at the housing.

Furthermore, the bucket comprises a clean water area and a dirty water area. The roller is disposed in the clean water area. The roller is rotatably disposed relative to a bucket body with the axis thereof as the rotation axis; during cleaning, the support body supports the mop, the mop head rotates to drive the roller to rotate, the roller rotates to carry clean water from the clean water area to the mop head, and dirty water left after the mop head is cleaned flows to the dirty water area; and during dewatering, the mop head is supported by the support body in the dirty water area for dewatering through spinning.

Furthermore, the cleaning bucket comprises a clean water area and a dirty water area, and a baffle for blocking most of the clean water area is disposed above the clean water area; the roller is disposed in the clean water area, and the roller is rotatably disposed relative to the cleaning bucket with the axis thereof as the rotation axis; and during cleaning, the support body supports the mop, the mop head rotates to drive the roller to rotate, the roller rotates to carry clean water from the clean water area to the mop head, and dirty water left after the mop head is cleaned flows to the dirty water area.

Furthermore, the mop cleaning system further comprises a rotary roller and a water feeding belt. The rotary roller is rotatably disposed relative to the cleaning bucket. The water feeding belt is sleeved over the roller and the rotary roller.

Furthermore, a partition isolating dirty water in the dirty water area is disposed in the cleaning bucket. An extending line of the partition intersects with the roller or the water feeding belt. The partition receives dirty water from the roller or the water feeding belt.

Furthermore, the mop cleaning system further comprises a clean water container, a water outlet leading from the clean water container, and a water valve for controlling the discharge of water from the water outlet. The internal height of the clean water container is higher than the water outlet. Water discharged from the water outlet flows to the mop head of the mop.

The present invention has the advantages and effects as follows as compared with the prior art:

1. In the present invention, when a mop is cleaned, the liquid level in a mop bucket may be below the mop head, and the liquid level only needs to be slightly higher than a roller. The roller rotates to carry the water below to the mop head to clean the mop head.

2. During rotation, the roller moves relative to the mop head. In use, a mop stick is pressed up and down, and a mop cloth can be cleaned with a same motion. Dirty water left after cleaning is not mixed with clean water, and water can be removed through acceleration, so that the mop head is cleaned rapidly and effectively.

3. The mop head is covered with a water feeding roller. Therefore, when the mop head is cleaned, water is stably controlled inside a bucket instead of splashing out a bucket body.

4. After a clean water container is disposed in the present invention, water discharged from the clean water container flows to the mop head, the mop head can be rinsed. When water discharge is turned off, the mop head continues to rotate for centrifugal dewatering.

5. The present invention has a simple structure but better functions as compared with the prior art, and the volume of the bucket is reduced. Therefore, the manufacturing costs and logistic costs are greatly reduced.

DETAILED DESCRIPTION OF THE INVENTION

Figure 1:
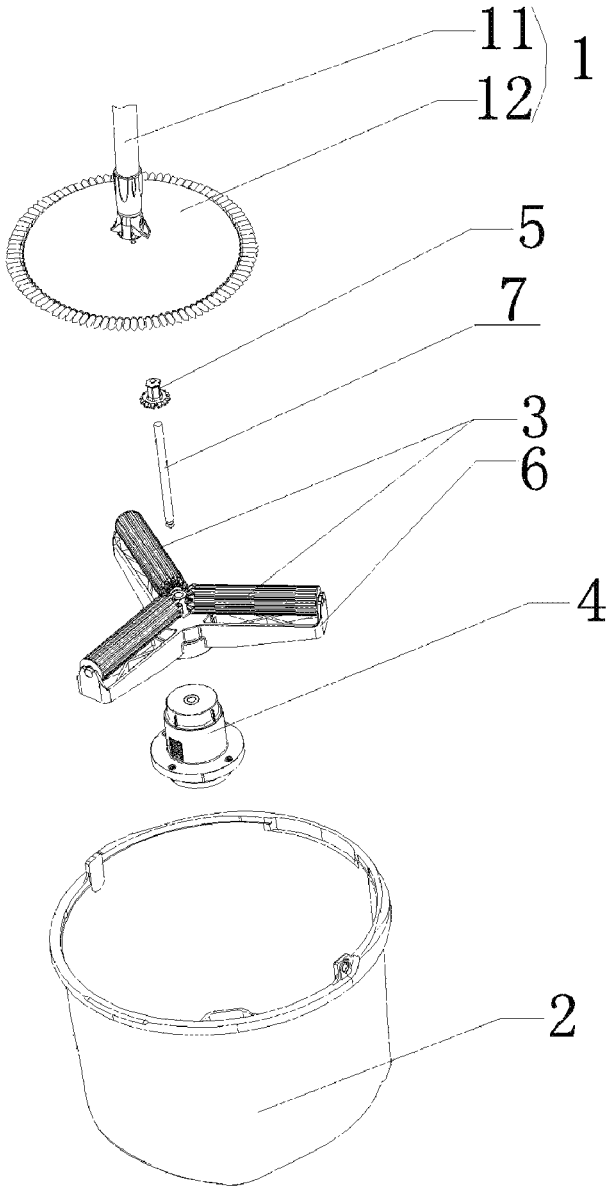
FIG. 1 is a schematic structural diagram of an exploded state according to the present invention.
Figure 2:
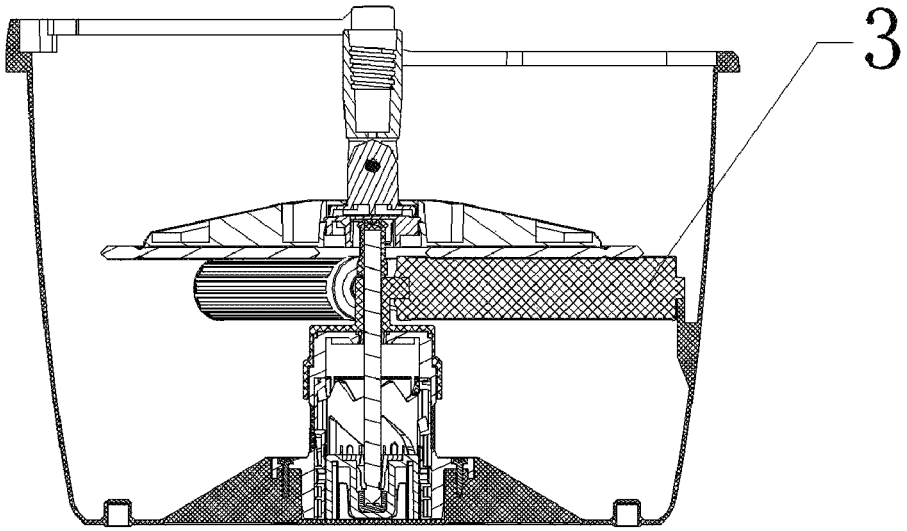
FIG. 2 is a schematic structural diagram of a roller being rotatably mounted according to the present invention.
Figure 3:
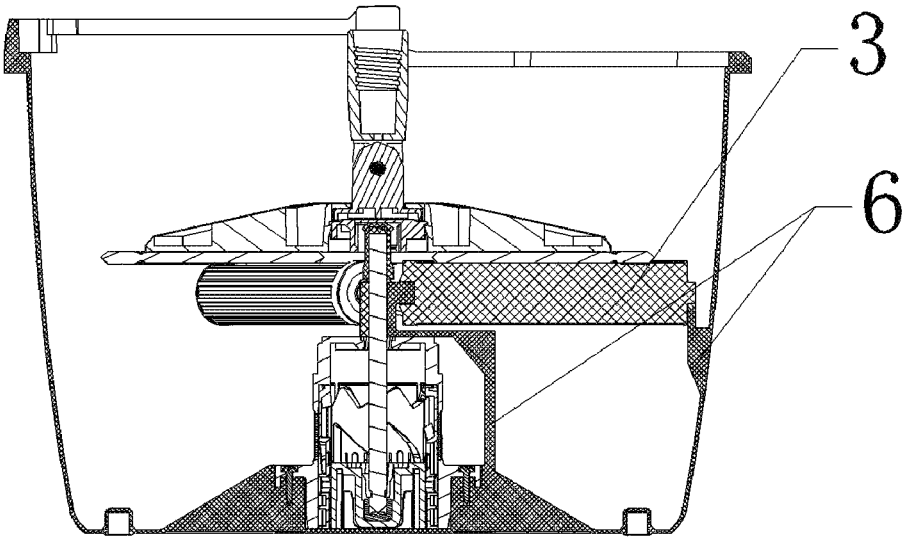
FIG. 3 is a schematic structural diagram of another implementation of a roller being rotatably mounted according to the present invention.
Figure 4:
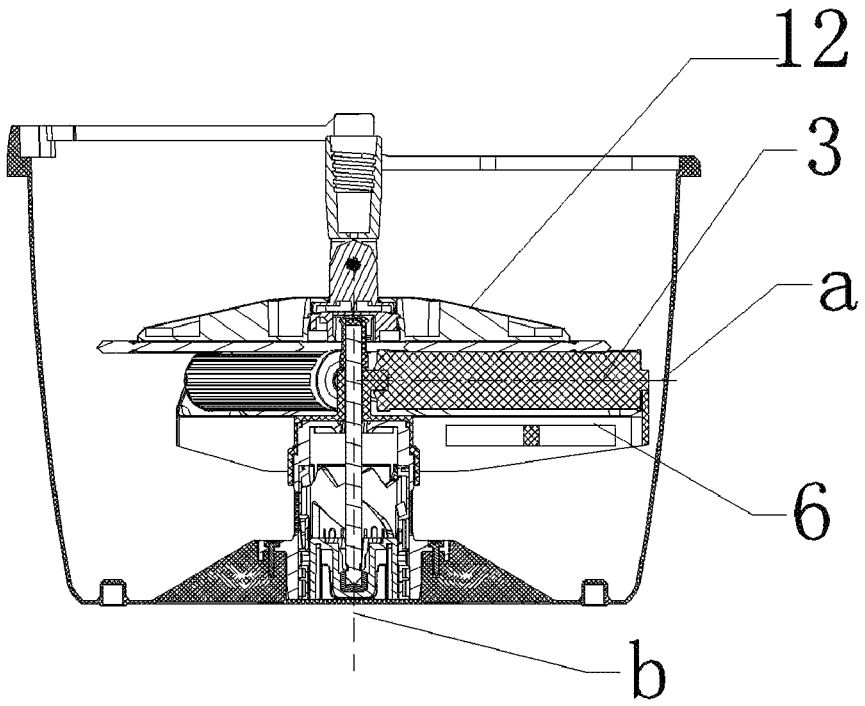
FIG. 4 is a schematic structural diagram of an implementation in which a mop rotates to drive a roller to rotate according to the present invention.

As shown in FIG. 1 to FIG. 4, the mop cleaning system of the present invention comprises a cleaning bucket 2 and a mop 1. The mop 1 comprises a mop stick 11 and a mop head 12. The mop stick 11 is connected to the mop head 12. A support body 4 supporting the mop 1 is disposed in the cleaning bucket 2. A roller 3 is disposed in the cleaning bucket 2. The roller 3 is rotatably disposed with the axis a thereof as a rotation axis. During cleaning, the mop head 12 rotates to drive the roller 3 to rotate.

The manner in which the roller 3 is rotatably disposed in the cleaning bucket 2 is as follows: I. one end of the roller 3 is rotatably connected to the support body 4, and the other end of the roller 3 is rotatably connected to an inner wall of the cleaning bucket 2; and II. the two ends of the roller 3 are rotatably connected to a roller mounting frame 6. The roller mounting frame 6 is connected to the cleaning bucket 2. The connection between the roller mounting frame 6 and the cleaning bucket 2 comprises a fixed connection between the roller mounting frame 6 and the bottom of the cleaning bucket 2. The connection between the roller mounting frame 6 and the support body 4 is supported by the roller mounting frame 6. The mop 1 in the present invention comprises a manual mop and an electric mop. In the manual mop, mop sticks that are sleeved over each other move up and down linearly to drive the mop head 12 to rotate. In the electric mop, a motor is used to drive the mop head 12 to rotate.

Figure 5:
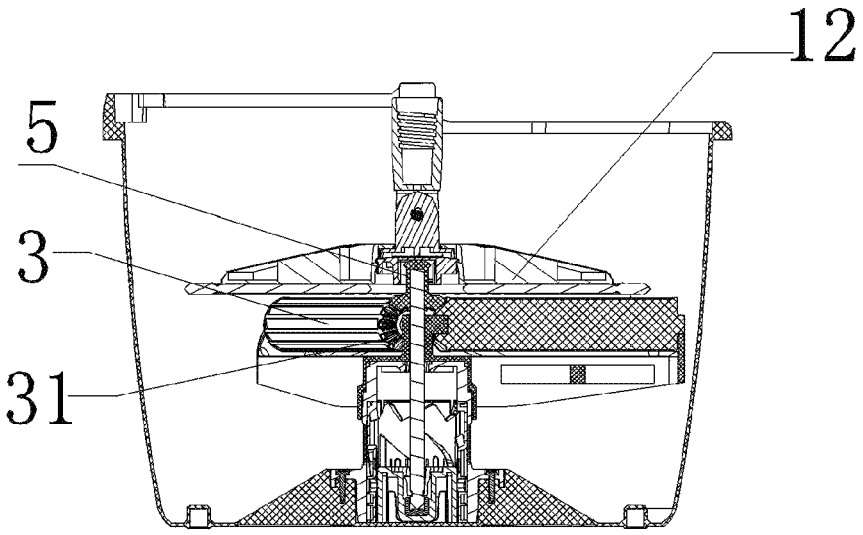
FIG. 5 is a schematic structural diagram of another implementation in which a mop rotates to drive a roller to rotate according to the present invention.
Figure 6:
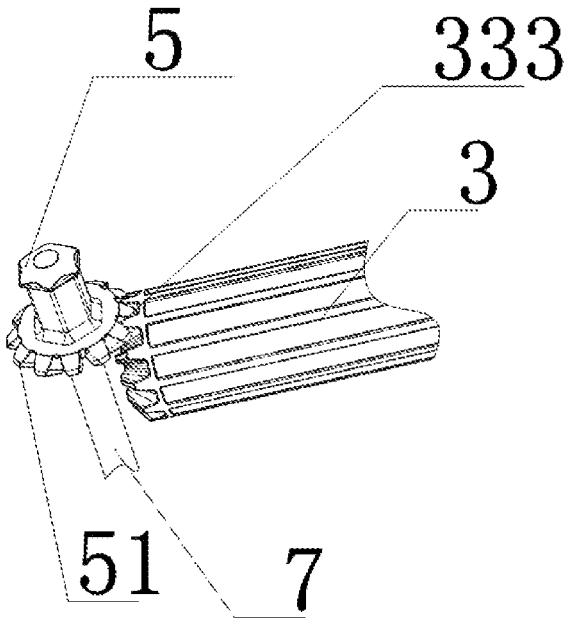
FIG. 6 is a schematic structural diagram of a rotating member and a roller transmission structure shown in FIG. 5.

As shown in FIG. 5 and FIG. 6, another implementation in which the mop 1 in the present invention rotates to drive the roller 3 to rotate further comprises a transmission mechanism. The transmission mechanism comprises a rotating member 5 and a driven gear 333 fixedly disposed at the roller 3, with one end of the rotating member 5 being provided with a driving gear 51 engaged with the driven gear 333, and the other end of the rotating member 5 being provided with a connecting structure for circumferentially limiting after being connected to the mop head 12. The rotating member 5 is rotatably connected to the support body 4 in the cleaning bucket 2 through a central shaft 7.

Preferably, the driven gear 333 and the driving gear 51 are both bevel gears, or one of the driven gear 333 and the driving gear 51 has end teeth while the other has straight teeth. When gear transmission is used, the transmission efficiency is higher, and the effect and efficiency of cleaning are better.

During implementation of the present invention, a water level in the cleaning bucket 2 may be just in contact with the roller 3. The roller 3 rotates to carry water to the mop head 12 to perform thorough cleaning on the mop head 12.

The connecting structure in the present invention comprises a hollow cavity and a convex body in which the hollow cavity can be embedded. The convex body is noncircular. The inner cavity of the hollow cavity is also noncircular. The convex body is circumferentially limiting after being embedded in the hollow cavity. The noncircular structure comprises a triangular structure, a quadrilateral structure, a hexagonal structure, and the like.

Preferably, the support body 4 of the present invention is disposed perpendicular to a bucket bottom of the cleaning bucket 2. The axial direction a of the roller 3 and an axial direction b of the support body 4 are disposed perpendicular to each other.

Figure 7:
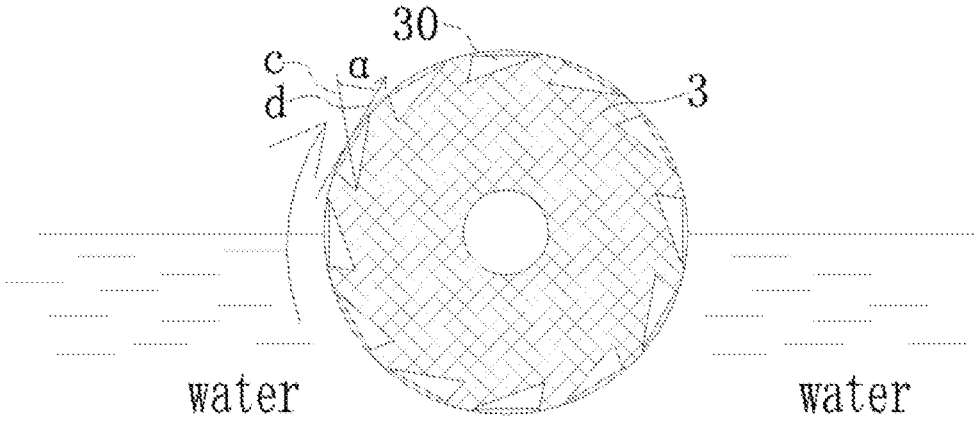
FIG. 7 is a schematic structural diagram of a roller according to the present invention.

As shown in FIG. 7, the roller 3 is provided with a water feeding groove 30, and an included angle $\alpha$ formed between a connecting line c from a middle point of an opening of the water feeding groove 30 to the bottom of the water feeding groove and a tangent line d extending from the middle point in a rotation direction is an acute angle. Because a facing direction of the opening of the water feeding groove 30 approximates to the rotation direction, when the roller 3 rotates in the rotation direction, the roller 3 can carry more water to the mop head 12 to implement rapid and effective cleaning.

Preferably, the roller 3 is provided with bumps or teeth. The bumps or teeth can effectively clean dirt on the mop head 12.

Preferably, the bumps or teeth are linearly arranged. An arrangement line of the bumps or teeth is parallel to a line of the axial direction a of the roller 3.

Preferably, the driven gear 333 and the driving gear 51 are both bevel gears, or one of the driven gear 333 and the driving gear 51 has end teeth while the other has straight teeth. When gear transmission is used, the transmission efficiency is higher, and the effect and efficiency of cleaning are better.

Preferably, the support body 4 comprises a fixed shaft and a lift shaft sleeved over each other and capable of axially moving relative to each other. The support body further comprises a track used to connect the fixed shaft and the lift shaft and a limiting boss fitting the track. The track comprises a bottom slot hole and a middle upper slot hole connected through a connecting slot; and A rotating shaft is mounted at a top end of the lift shaft. The rotating shaft is rotatably connected to the rotating member 5. The fixed shaft is fixedly connected to the cleaning bucket 2. When the lift shaft moves upwards, the mop 1 rotates to implement dewatering of the mop head 12. When the lift shaft moves downwards, the mop head 12 rotates, and the roller 3 also rotates, so that the mop head 12 can be effectively cleaned. A solution of implementing elevation of the support body 4 has been disclosed before the filing date of the Publication No. CN 203576444 U. In the present invention, the technical solution is applied to the creation in the present invention to optimize the product design.

Figure 13:
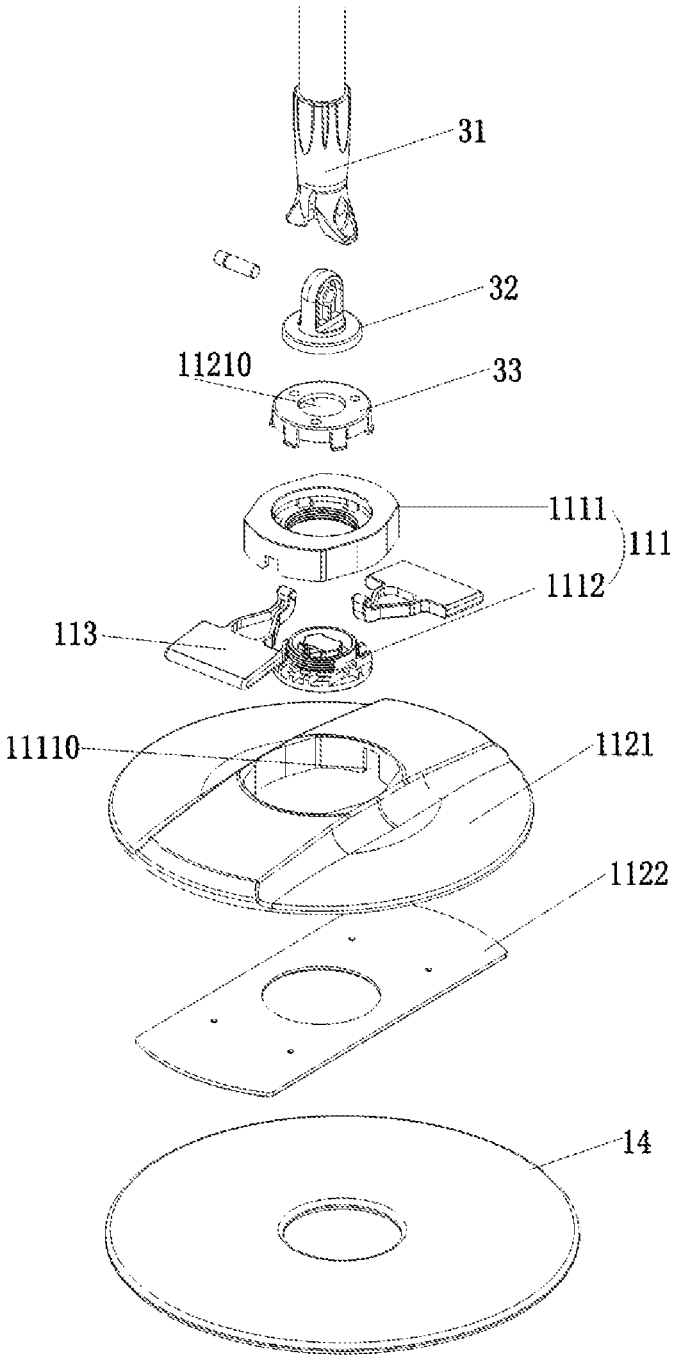
FIG. 13 is a schematic structural diagram of an exploded state of a mop according to the present invention.
Figure 14:
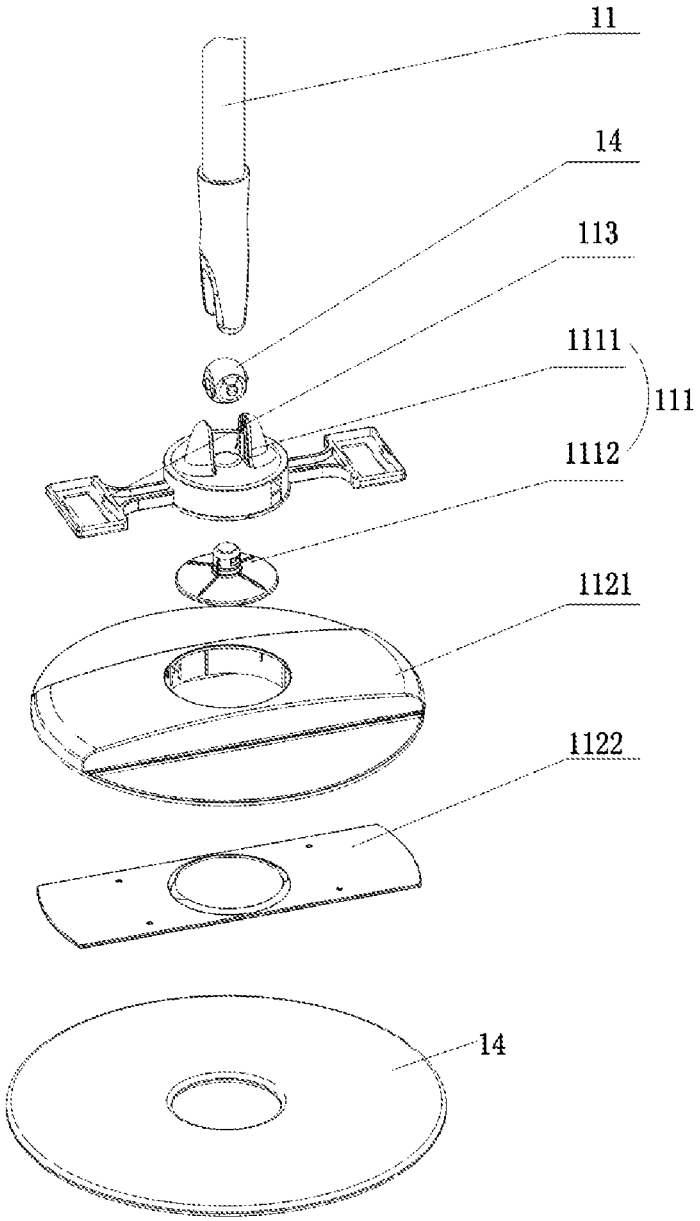
FIG. 14 is a schematic structural diagram of an exploded state of another implementation of a mop according to the present invention.

The present invention may use a mop as an alternate manner for the foregoing support body of elevation. As shown in FIG. 13 and FIG. 14, the mop head 12 of the present invention comprises a base 111, a housing 112, and a swing member 113. The swing member 113 is rotatably connected to the base 111. The swing member 113 is connected to or supports the housing 112. During high speed rotation, the swing member 113 extends to drive the housing 112 to rise.

A spare space for accommodating the swing member 113 is provided inside the housing 112. The base 111 is disposed in the middle of the housing 112. The housing 112 comprises an upper cover 1121. The upper cover 1121 is provided with an open hole 11210. The base 111 is disposed at the open hole 11210. One end of the swing member 113 is rotatably connected to the base 111. The other end of the swing member 113 is disposed in the spare space. The spare space is relatively low, the height of the spare space is 0.5-2 cm, but the radial length of the swing member 113 is obviously greater than the height of the spare space, and therefore the travel of the swing member 113 is restricted by the height of the spare space. Therefore, the housing 112 and the base 111 implement the restriction in a movement travel by using the swing member 113, are not separated in physical space after being assembled, and at the same time can move relative to each other. In a further mounting manner in which the housing 112 is movably mounted relative to the base 111, the lower portion of the base 111 is relatively expanded, a part of the base 111 can pass through the open hole 11210 of the upper cover 1121, and the other part is expanded and thus cannot pass through the open hole 11210, so that the housing and the base are not separated in physical space, but can move relative to each other.

The mop stick 11 can be movably connected to the base 111 through a movable connector. During use by a user, it is more convenient to rotate to a suitable angle.

Figure 15:
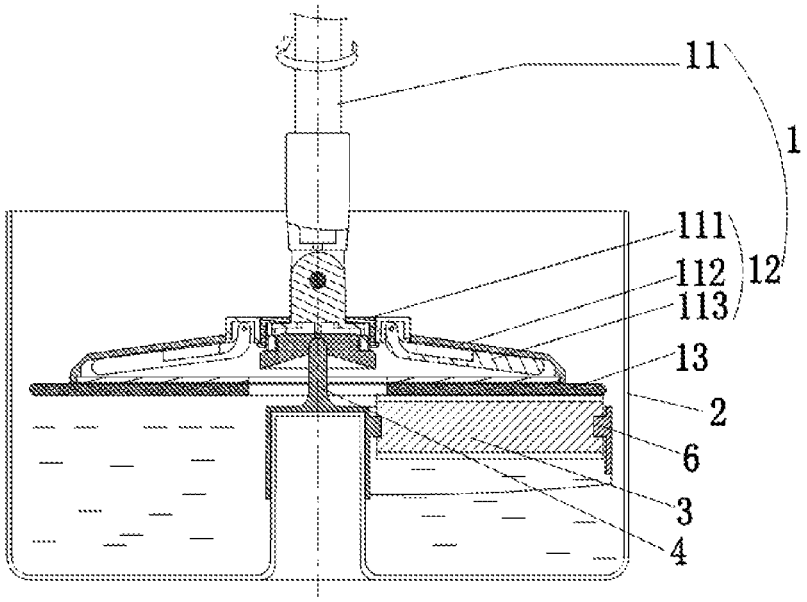
FIG. 15 is a schematic structural diagram of a mop and a roller being in a combined state according to the present invention.

Referring to FIG. 13 and FIG. 15, the roller 3 and the support body 4 are disposed in the cleaning bucket 2. An end of the support body 4 is fixedly connected to a bucket bottom. The roller 3 is rotatably disposed with the axis thereof as the rotation axis. During cleaning, a water level in the bucket is just in contact with the roller 3. The mop head 12 is placed in the support body 4. When the mop head 12 rotates at a slow speed, a mop cloth 14 drives the roller 3 to rotate. The roller 3 rotates to carry water to the mop cloth 14. At the same time, the roller 3 and the mop cloth 14 roll relative to each other, so that the mop cloth 14 can be effectively cleaned. When the mop head 12 rotates rapidly, the swing member 113 drives the housing 112 to move upward under a centrifugal effect. Because the mop cloth 14 is bonded below the housing 112, the mop cloth 14 also moves upwards with the housing 112. In this way, the mop cloth 14 is detached from the roller 3. The roller is not driven by the mop cloth 14 and cannot rotate, and water cannot be carried to the mop cloth 14. Water is removed during high speed rotation, so that centrifugal dewatering is implemented.

The housing 112 comprises an upper cover 1121 and a bottom plate 1122. The upper cover 1121 and the bottom plate 1122 have, after being joined, a spare space for accommodating the swing member 113. The swing member 113 is disposed in the spare space. The swing member 113 is filled between the upper cover 1121 and the bottom plate 1122, so that a height space is compressed, and the mop head 12 can be thinner.

The upper cover 1121 is provided with an open hole 11210, the base 111 is disposed at the open hole 11210, the base 111 comprises an upper base 1111 and a lower base 1112, the upper base 1111 is provided with a notch 11110, the swing member 113 moves in the notch 11110 and is rotatably connected to the upper base 1111, and the upper base 1111 is threadedly connected to the lower base 1112. By means of the upper base 1111 being screwed to the lower base 1112, the swing member 113 can be mounted, so that the mounting is convenient and fast.

According to the present invention, the lower base 1112 is provided with a concave cavity disposed corresponding to the support body 4. The correspondence between the mop head 12 and the cleaning bucket can be rapidly implemented.

Referring to FIG. 13, the present invention further comprises a movable connector. The movable connector comprises an upper connector 31, a lower connector 32, and a cover plate 33. The upper connector 31 comprises a column body and a flange extending outwardly relative to the column body. The upper connector 31 is rotatably connected to the lower connector 32. The cover plate 33 is provided with an open hole 11210 that obstructs the flange but allows the column body to pass through. The upper connector 31 is sealed at the upper base 1111 by the cover plate 33.

The spare space is formed by the upper cover 1121 protruding. Spare spaces are isolated from each other. The swing member 113 is therefore also isolated, and an isolation belt limits a movement space of the swing member, so as to avoid circumferential rotation.

As shown in FIG. 14, another implementation in which the mop stick 11 is movably connected to the mop head 12 in the present invention further comprises a universal joint 14. The base 111 and the mop stick 11 may be respectively rotatably connected to the universal joint 14. An axial line in which the base 111 is rotatably connected to the universal joint 14 may intersect perpendicularly with an axial line in which the mop stick 11 is rotatably connected to the universal joint 14. Currently, a vertical direction is required when the mop stick 11 compresses an upper tube, and once the mop stick 11 is inclined, it becomes difficult to drive the mop stick to rotate. In this application, after the universal joint 14 is disposed, in an inclined direction, a lower tube can be easily driven to rotate, so that operations are further facilitated.

Figure 16:
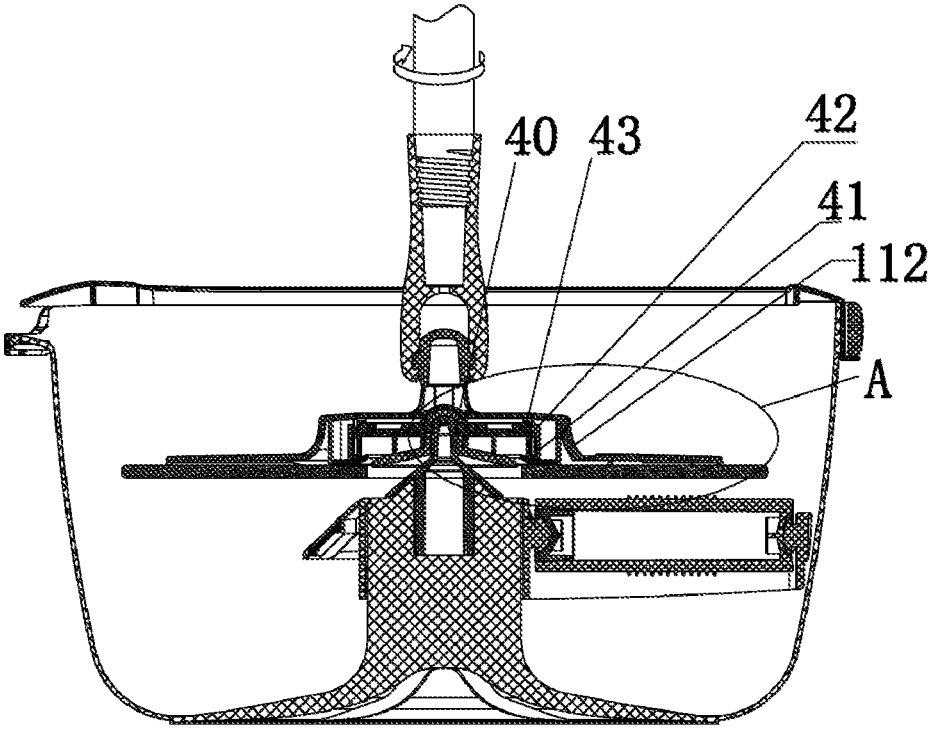
FIG. 16 is a schematic structural diagram of a locking mechanism according to the present invention.
Figure 17:
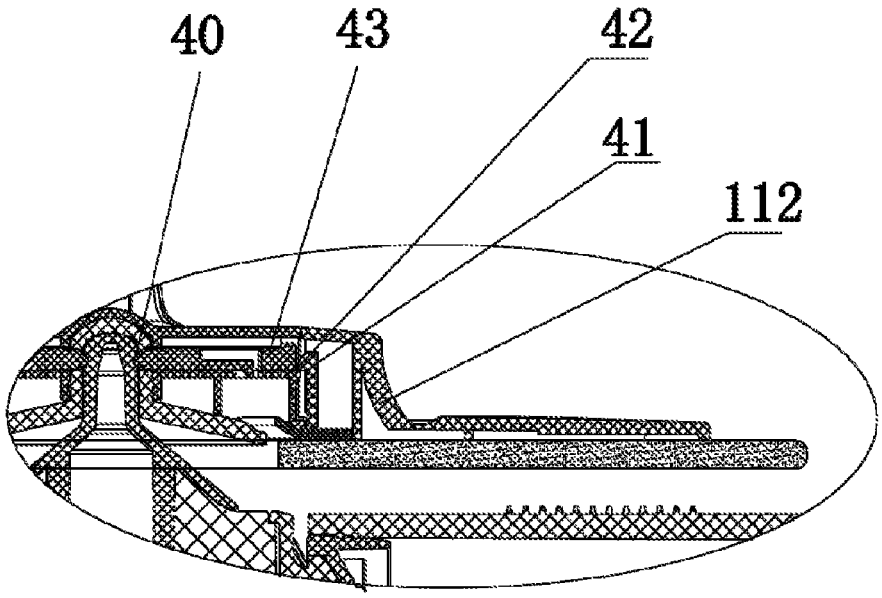
FIG. 17 is a schematic structural diagram of a portion A in FIG. 16 being partially enlarged.

As shown in FIG. 16 and FIG. 17, the mop further comprises a locking mechanism for locking the housing 112 and the base 111. The locking mechanism comprises a hook 41, a hanged portion 42, a control member 43, and a recess 40 provided on the support body of the cleaning bucket 4. The hook 41 is disposed in the housing 112. The hanged portion 42 is disposed in the base 111. When the mop head 12 is placed at the support body 4, the support body 4 applies a force to the control member 43 to push the hanged portion 42 to be unhooked from the hook 41, and then the control member 43 is seated into the recess 40. In this case, the control member 43 is not held against the hook 41. After the swing member 113 drives the housing 112 to rise, the hook 41 and the hanged portion 42 are securely hooked, and the housing 112 and the base 111 are locked. During mopping, the housing 112 is subject to an external force and moves relatively upwards, and the hook 41 and the hanged portion 42 are securely hooked. In the present invention, the arrangement positions of the hook 41 and the hanged portion 42 can also be interchanged.

Figure 8:
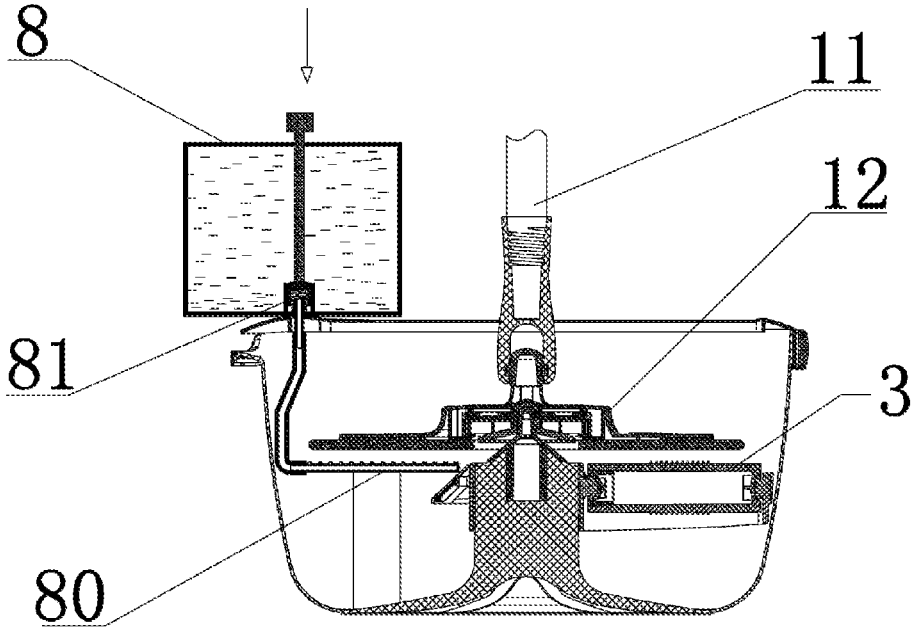
FIG. 8 is a schematic structural diagram of a clean water container being added according to the present invention.

To improve the cleaning effect of the mop head and implement the use of clean water during cleaning each time, as shown in FIG. 8, the present invention further comprises a clean water container 8, a water outlet 80 leading from the clean water container 8, and a water valve 81 for controlling the discharge of water from the water outlet 80. Water in the clean water container 8 is higher than the water outlet 80. Water discharged from the water outlet 80 flows to the mop head 12 of the mop 1. When the mop head 12 is cleaned, the water valve 81 is opened. Clean water that flows out from the water outlet 80 rinses the mop head 12. During spin drying, the water valve 81 is turned off, and the mop head 12 rotates to implement dewatering.

To resolve the problem of splashing water that is centrifugally thrown out during the rotation of the mop head 12, in the present invention, a rotary body 13 covers the cleaning bucket 2.

Figure 9:
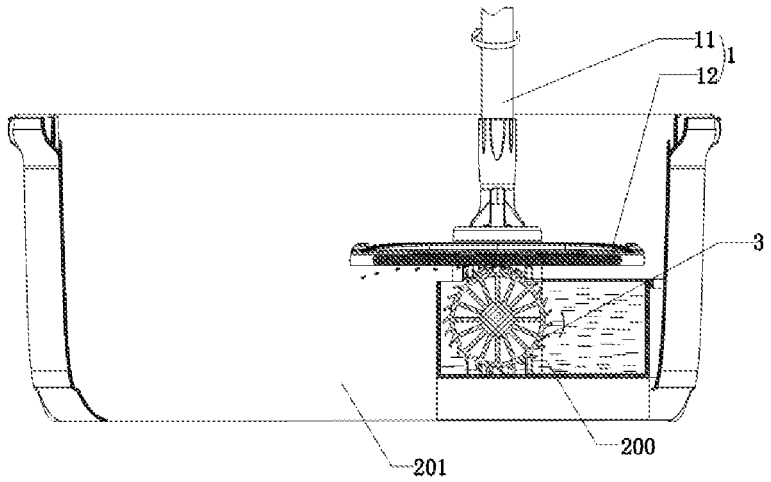
FIG. 9 is a schematic structural diagram of division areas of a cleaning bucket according to the present invention.

As shown in FIG. 9, the cleaning bucket 2 comprises a clean water area 200 and a dirty water area 201. The clean water area 200 is filled with clean water. The dirty water area 201 collects dirty water left after the mop 1 is cleaned. The roller 3 is disposed in the clean water area 200. The roller 3 is rotatably disposed relative to the bucket with the axis thereof as the rotation axis. During cleaning, the support body 4 supports the mop 1. The mop head 12 rotates to drive the roller 3 rotate. A water level of the clean water in the clean water area 200 is in contact with the roller 3. The roller 3 rotates to carry the clean water from the clean water area 200 to the mop head 12. The roller 3 is disposed in the clean water area 200 and disposed near the dirty water area 201. Preferably, the roller 3 is disposed at a boundary line between the clean water area 200 and the dirty water area 201. After dirty water left after the mop head 12 is cleaned flows to the dirty water area 201 under inertia. During dewatering, the mop head 12 is supported by the support body in the dirty water area 201 for dewatering through spinning. Dirty water from centrifugal dewatering is collected in the dirty water area 201.

Figure 10:
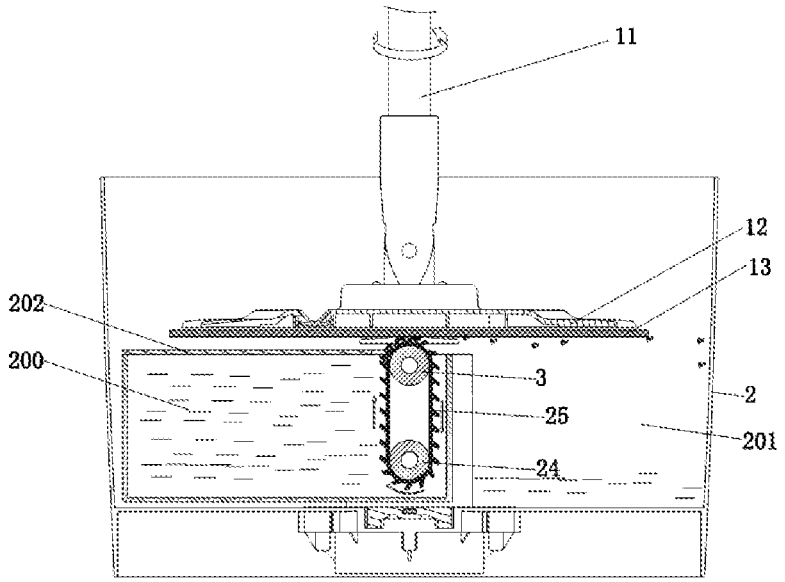
FIG. 10 is a schematic structural diagram of a cleaning state according to the present invention.
Figure 11:
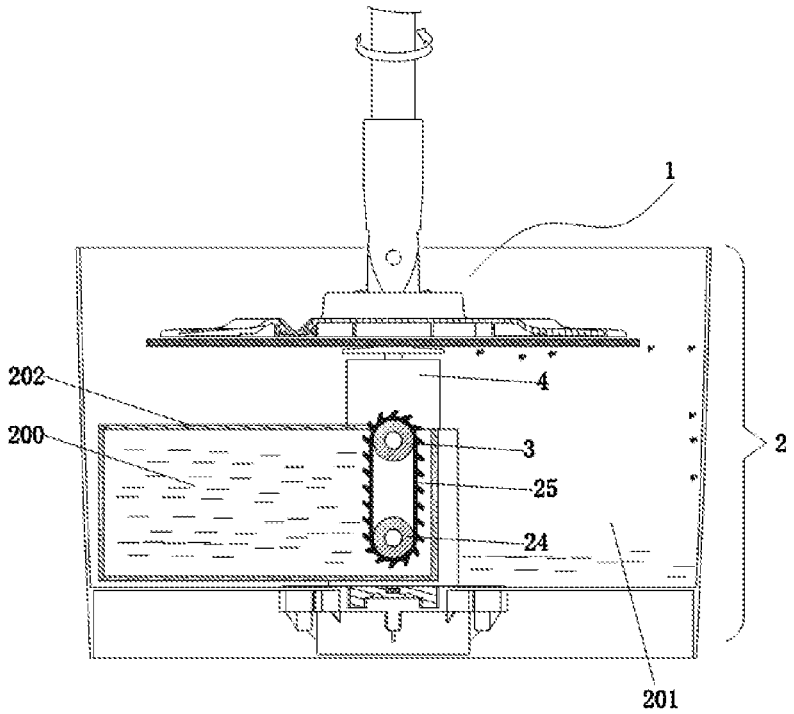
FIG. 11 is a schematic structural diagram of a dewatering state according to the present invention.

Referring to FIG. 10 and FIG. 11, the bucket 2 of the present invention comprises a clean water area 200 and a dirty water area 201. Generally, the clean water area 200 and the dirty water area 201 are separated from each other. A baffle 202 for blocking most of the clean water area 200 is disposed above the clean water area 200. The baffle 202 blocks dirty water that is sprinkled from the mop head 12. The roller 3 is disposed in the clean water area 200. The roller 3 is rotatably disposed relative to the bucket 2 with the axis thereof as the rotation axis. Preferably, an extension of a rotation axis of the roller 3 intersects with the support body 4.

During cleaning, clean water is filled in the clean water area 200. A water surface of the clean water is in contact with the roller 3. The support body 4 supports the mop 1. The mop head 12 rotates to drive the roller 3 to rotate. The roller 3 rotates to carry the clean water from the clean water area 200 to the mop head 12. When the mop head 12 rotates, dirty water is thrown out under a centrifugal effect. Because the baffle 202 blocks the clean water area 200, the dirty water flows to the dirty water area 201. Water carried by the roller 3 during rotation also flows to the dirty water area 201 under inertia. Therefore, dirty water left after the mop head 12 is cleaned flows to the dirty water area 201, so that clean water is separated from dirty water after cleaning.

A rotary roller 24 and a water feeding belt 25 are further comprised based on the present invention. The rotary roller 24 is rotatably disposed relative to the bucket 20. The water feeding belt 25 is sleeved over the roller 3 and the rotary roller 24. A water level in the clean water area 200 has a depth. The water feeding belt 25 is disposed as an extension to carry water at the bottom to the mop head 12.

Figure 12:
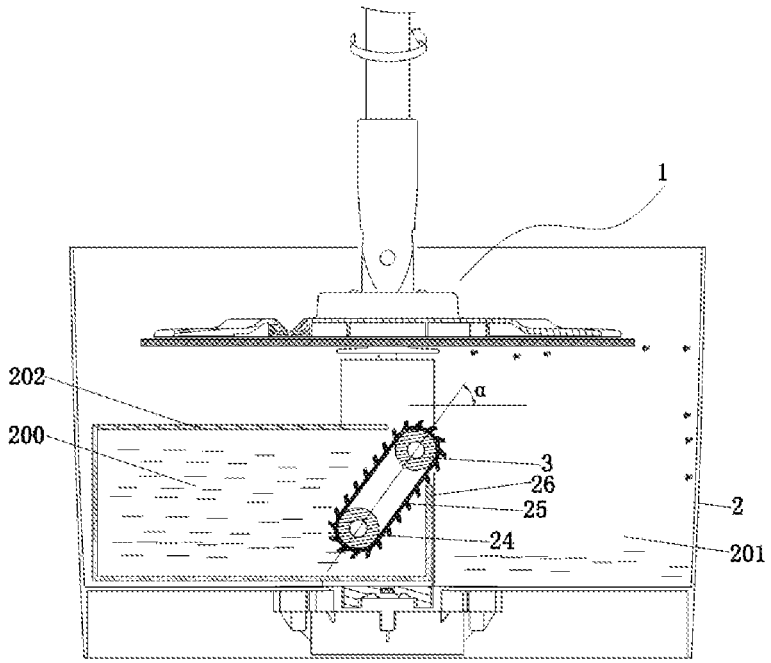
FIG. 12 is a schematic structural diagram of a connected line between axes of a roller and a rotary roller being in an inclined state according to the present invention.

As seen in FIG. 12, a partition 26 isolating dirty water in the dirty water area 201 is disposed in the bucket 20 of the present invention. An extending line of the partition 26 intersects with the roller 3 or the water feeding belt 25. The partition 26 receives dirty water from the roller 3 or the water feeding belt 25. In the foregoing structure, the roller 3 is disposed on a side of the dirty water area 201 of the partition 26. Dirty water that falls under gravity also falls in the dirty water area 201.

An included angle α of 20° is formed between connecting line between axes of the roller 3 and the rotary roller 24 in the present invention and the horizontal plane. The water-feeding efficiency at an inclined angle is higher than that in a perpendicular case.

According to the present invention, an included angle α of 90° is formed between a connecting line between axes of the roller 3 and the rotary roller 24 and the horizontal plane. A perpendicular setting can save space.

The foregoing content described in this specification is merely exemplary description of the present invention. Various modifications or supplements or replacements in similar manners made by person skilled in the technical field of the present invention to the described specific invention without departing from the content in the specification of the present invention or going beyond the scope defined in the claims should all fall within the protection scope of the present invention.

The invention claimed is:

1. A mop cleaning system, comprising:

a cleaning bucket, a spin mop, wherein the spin mop comprising a mop stick and a mop head, wherein the mop stick being connected to the mop head, wherein a support body supporting the mop being disposed in the cleaning bucket, wherein a roller is disposed in the cleaning bucket, wherein the roller is rotatably disposed with an axis thereof as a rotation axis, wherein the mop head rotates to drive the roller to rotate, wherein the roller transfers water from the cleaning bucket and cleans the mop head, wherein a roller mounting frame is disposed at the support body and/or the cleaning bucket and rotatably connected to the roller mounting frame, wherein one end of the roller is rotatably connected to the support body and another end of the roller is rotatably connected to the cleaning bucket, wherein a structure by which the mop rotates to drive the roller to rotate is that when the mop head is placed in the support body for cleaning, the mop head is in contact with the roller, wherein the structure by which the mop rotates to drive the roller to rotate further comprising a transmission mechanism, and the transmission mechanism comprises a rotating member and a driven gear fixedly disposed at the roller, with one end of the rotating member being provided with a driving gear engaged with the driven gear, and another end of the rotating member being provided with a connecting portion for circumferentially limiting after being connected to the mop head, and the rotating member is rotatably connected to the support body.

2. A mop cleaning system of claim 1, wherein the axial direction of the roller and an axial direction of the support body are disposed perpendicular to each other.

3. The mop cleaning system of claim 1, wherein the support body is disposed perpendicular to a bucket bottom of the cleaning bucket, and axial direction of the roller and axial direction of the support body are disposed perpendicular to each other.

4. The mop cleaning system of claim 1, wherein the roller is provided with a water feeding groove.

* * * * *